US007156480B2

(12) United States Patent
Norigoe

(10) Patent No.: US 7,156,480 B2
(45) Date of Patent: Jan. 2, 2007

(54) INK-JET HEAD DRIVING METHOD AND INK-JET RECORDING APPARATUS

(75) Inventor: Takashi Norigoe, Mishima (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 295 days.

(21) Appl. No.: 10/833,718

(22) Filed: Apr. 27, 2004

(65) Prior Publication Data

US 2005/0018003 A1 Jan. 27, 2005

(30) Foreign Application Priority Data

Jul. 25, 2003 (JP) ..... 2003-201719

(51) Int. Cl.
*B41J 29/38* (2006.01)

(52) U.S. Cl. ..... 347/10; 347/11

(58) Field of Classification Search ..... 347/10
See application file for complete search history.

(56) References Cited

U.S. PATENT DOCUMENTS

| | | | | |
|---|---|---|---|---|
| 5,764,247 | A | 6/1998 | Asai | |
| 5,980,034 | A | 11/1999 | Tsai et al. | |
| 6,106,092 | A | 8/2000 | Norigoe et al. | |
| 6,109,716 | A | 8/2000 | Takahashi | |
| 6,123,405 | A | 9/2000 | Temple et al. | |
| 6,193,343 | B1 | 2/2001 | Norigoe et al. | |
| 6,231,174 | B1 * | 5/2001 | Haigo | 347/89 |
| 6,378,973 | B1 | 4/2002 | Kubota et al. | |
| 6,409,295 | B1 | 6/2002 | Norigoe | |
| 2004/0041871 | A1 | 3/2004 | Davis et al. | |

FOREIGN PATENT DOCUMENTS

| | | | |
|---|---|---|---|
| EP | 0 652 106 | A2 | 5/1995 |
| EP | 652106 | A2 * | 5/1995 |
| EP | 0 751 873 | B1 | 11/1998 |
| JP | 57-61576 | A | 4/1982 |
| JP | 9-29996 | A | 2/1997 |
| JP | 2001-26107 | A | 1/2001 |

* cited by examiner

*Primary Examiner*—Vip Patel
*Assistant Examiner*—Jannelle M. Lebron
(74) *Attorney, Agent, or Firm*—Frishauf, Holtz, Goodman & Chick, P.C.

(57) ABSTRACT

An ink-jet recording apparatus includes a pressure chamber that contains ink, a nozzle communicating with the pressure chamber, which ejects the ink from the pressure chamber, an ink-jet head having an actuator that increases and decreases the capacity of the pressure chamber, and a driving signal generation unit that supplies the actuator with a driving signal to eject an ink drop from the nozzle. When no ink is ejected from the nozzle, the actuator is supplied with a very low pressure driving signal to increase the capacity of the pressure chamber and then return the increased capacity to an original size. The pulse width of the very low pressure driving signal is about twice as long as a pressure propagation time period during which a pressure wave in the ink propagates through the pressure chamber.

9 Claims, 4 Drawing Sheets

FIG. 9A
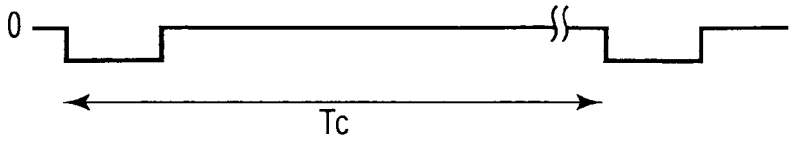
FIG. 9B
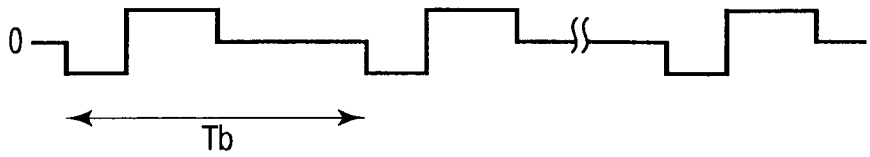
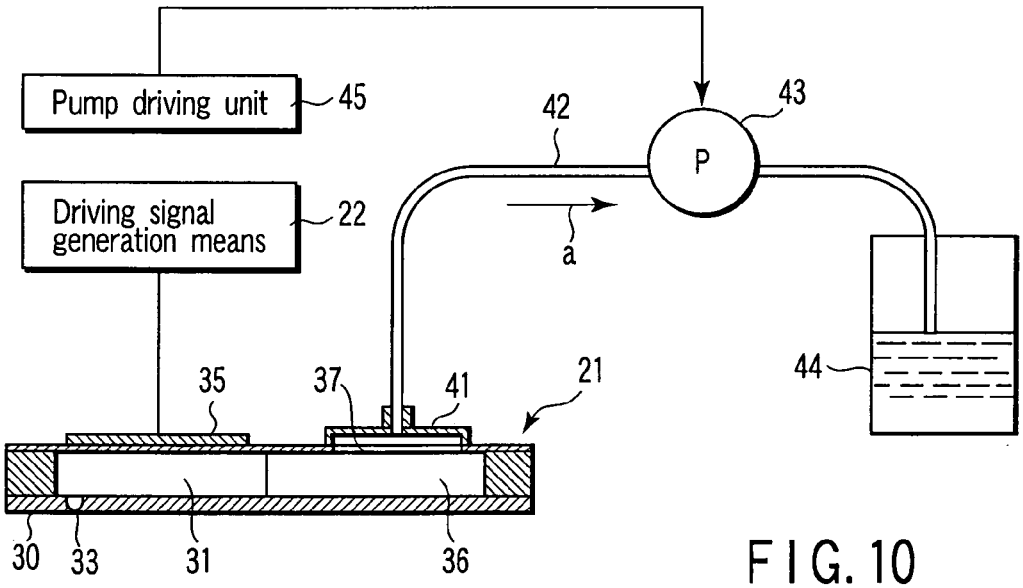
FIG. 10
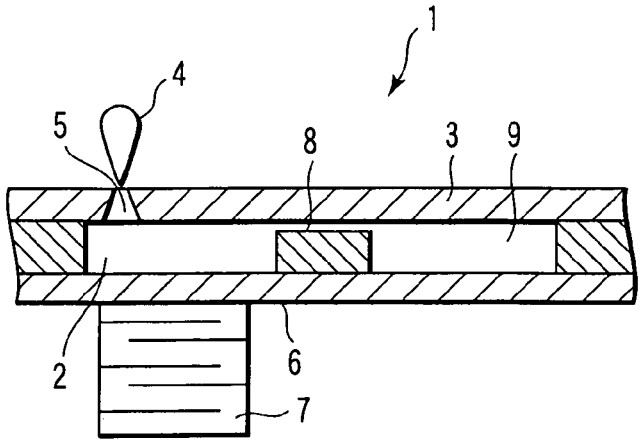
FIG. 11

INK-JET HEAD DRIVING METHOD AND INK-JET RECORDING APPARATUS

CROSS-REFERENCE TO RELATED APPLICATIONS

This application is based upon and claims the benefit of priority from prior Japanese Patent Application No. 2003-201719, filed Jul. 25, 2003, the entire contents of which are incorporated herein by reference.

BACKGROUND OF THE INVENTION

1. Field of the Invention

The present invention relates to an ink-jet head driving method and an ink-jet recording apparatus in which an ink drop is ejected from a nozzle by varying the capacity of a pressure chamber that contains ink.

2. Description of the Related Art

FIG. 11 illustrates a configuration of a conventional ink-jet recording head. In FIG. 11, reference numeral 1 indicates an ink-jet recording head. The ink-jet recording head 1 includes a plurality of pressure generating chambers 2 to be filled with ink, a nozzle plate 3 provided at one end of each of the pressure generating chambers 2, a nozzle 5 provided in each of the pressure generating chambers 2 to eject an ink drop 4, a piezoelectric actuator 7 for giving vibration to the pressure generating chambers 2 through a vibrating plate 6 and ejecting ink from the nozzle 5 by varying the capacity of the pressure generating chambers 2 with the vibration, and an ink chamber 9 that communicates with each of the pressure generating chambers 2 to supply ink to the pressure generating chambers 2 from a tank (not shown) through an ink supply path 8.

With the above configuration, when the piezo-electric actuator 7 is driven, the pressure generating chambers 2 are vibrated. This vibration varies the capacity of the chambers 2 to eject an ink drop 4 from the nozzle 5. The ink drop 4 reaches a recording medium such as recording paper and forms a dot thereon. If such dots are formed in sequence, given characters, images, etc., which correspond to image data, are printed on the recording medium.

In the ink-jet recording head 1 described above, an ink drop needs ejecting with stability to correctly print characters and images on a recording medium based on input printing information.

However, the actual use of the ink-jet recording head 1 for printing may cause a problem in which an ink drop is ejected unstably due to various factors and thus a desired printing result cannot be obtained. One of the factors is evaporation of volatile components from ink.

More specifically, ink used for ink-jet recording employs water as the main solvent, and coloring such as various kinds of organic solvent dye such as a surface-active agent is added to the water. If no ink drops for some long period of time, moisture is drawn from an opening of the nozzle 5 that is exposed to outside air. The ink therefore increases in viscosity or partly solidifies to block the nozzle 5.

The above problem is resolved as follows. The ink-jet recording head 1 moves away from a printing area and ink is discharged from the ink chamber 9, or ink is discharged from the nozzle 5 by forcibly sucking new ink through the nozzle 5 by means of a pump.

In order to eject ink from the nozzle 5 for high-quality printing with stability, however, the above operation has to be performed frequently. This causes the following problem.

An amount of ink consumed increases and so do printing costs, and a large amount of ejected ink should be disposed of.

As a method of resolving the above problem, for example, Jpn. Pat. Appln. KOKAI Publications Nos. 57-61576 and 9-29996 disclose an operation of providing a pressure generating chamber with such a small vibration that no ink drops jump out of the nozzle even when no ink drops are ejected from the nozzle (this operation is called a precursor).

There now follows an explanation as to the precursor referring to FIGS. 12A to 12E. The figures are enlarged views of a nozzle portion of the ink-jet recording head 1. Ink 11 in the pressure generating chamber 2 is exposed to outside air at a portion 13 of the opening 12 of the nozzle 5 as illustrated in FIG. 12A. In the portion 13, as shown in FIG. 12B, moisture is drawn from the ink 11 to form a high viscosity ink layer 14 near the meniscus. If a precursor is carried out as shown in FIGS. 12C and 12D, the meniscus vibration very slightly. With this vibration, the high viscosity ink layer 14 and low viscosity ink layer 23 are agitated to uniform the viscosity of ink in the pressure generating chamber 2 as illustrated in FIG. 12E. In FIG. 12E, reference numeral 15 denotes ink whose viscosity is uniformed.

In order to perform the precursor, a driving voltage that is lower than that for ejecting a normal ink drop has to be applied. Another driving power supply is required accordingly.

Although the above operation (precursor) is effective if no ink drop is ejected for a short period of time, it simply decreases the speed at which the viscosity of ink increases because the ink 11 in the nozzle 5 is not replaced with a new one. If, therefore, no ink drop is ejected for a long period of time, the ink 11 will solidify in the nozzle 5, which makes it difficult or impossible to eject an ink drop again.

When the very small vibration changes the meniscus from a convex to a concave as shown in FIGS. 13B to 13D, ink 11*a* that increases in viscosity is likely to attach and remain on the nozzle plate 3 near the nozzle. The ink remaining on the nozzle plate 3 causes the ink ejecting direction to be shifted.

For example, Jpn. Pat. Appln. KOKAI Publication No. 9-29996 described above discloses a method including a step (precursor) of providing such a small vibration that no ink drops jump out of the nozzle even when no ink drops are ejected from the nozzle and a step of retreating the ink-jet recording head from a printing area in a fixed period of time and ejecting the ink 11 from the pressure generating chamber 2 and from near the opening of the nozzle 5 (hereinafter referred to as a spit operation). The spit operation requires its own driving voltage waveform whose potential difference is greater than that of a driving voltage waveform used for normal printing, and a large amount of ink 11 is ejected from the pressure generating chamber 2 and replaced with a new one, thereby preventing ink from solidifying and increasing in viscosity for a long period of time.

The method of the Publication necessitates a driving waveform exclusively for the spit operation, and the driving waveform requires three different waveforms of a normal ejecting waveform, a precursor driving waveform and a spit driving waveform. The number of driving power supplies therefore increases to make a driving circuit complicated and thus make the ink-jet recording apparatus expensive.

If the ink-jet recording apparatus turns off and sits idle for a long period of time without performing any precursor or spit operation, the ink 11 remaining near the nozzle 5 increases in viscosity and easily solidifies.

In an ink ejecting operation prior to a printing operation, too, ink that increases in viscosity is attached to the periphery of the nozzle 5 of the nozzle plate 3, as is a coagulation of solidified ink, thereby shifting the ink ejecting direction.

BRIEF SUMMARY OF THE INVENTION

An object of the present invention is to provide an ink-jet head driving method and an ink-jet recording apparatus each capable of preventing ink that increases in viscosity and a coagulation of solidified ink from attaching to the periphery of a nozzle.

According to an aspect of the present invention, there is provided an ink-jet head driving method of an ink-jet recording apparatus including a pressure chamber that contains ink, a nozzle communicating with the pressure chamber, which ejects the ink from the pressure chamber, an ink-jet head having an actuator that increases and decreases a capacity of the pressure chamber, and a driving signal generation unit that supplies the actuator with a driving signal to eject an ink drop from the nozzle, the method comprising supplying the actuator with a very low pressure driving signal to increase the capacity of the pressure chamber and then return the increased capacity to an original size when no ink is ejected from the nozzle, a pulse width of the very low pressure driving signal being about twice as long as a pressure propagation time period during which a pressure wave in the ink propagates through the pressure chamber.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIGS. 9A and 9B are illustrations of a period of each of the driving pulse for ink ejection and the driving pulse for the precursor in the ink-jet recording head according to the first embodiment of the present invention.

FIG. 10 is a schematic block diagram of an ink-jet recording head apparatus according to a second embodiment of the present invention.

FIG. 11 is a sectional view showing a configuration of a conventional ink-jet recording head.

DETAILED DESCRIPTION OF THE INVENTION

Figure 1:
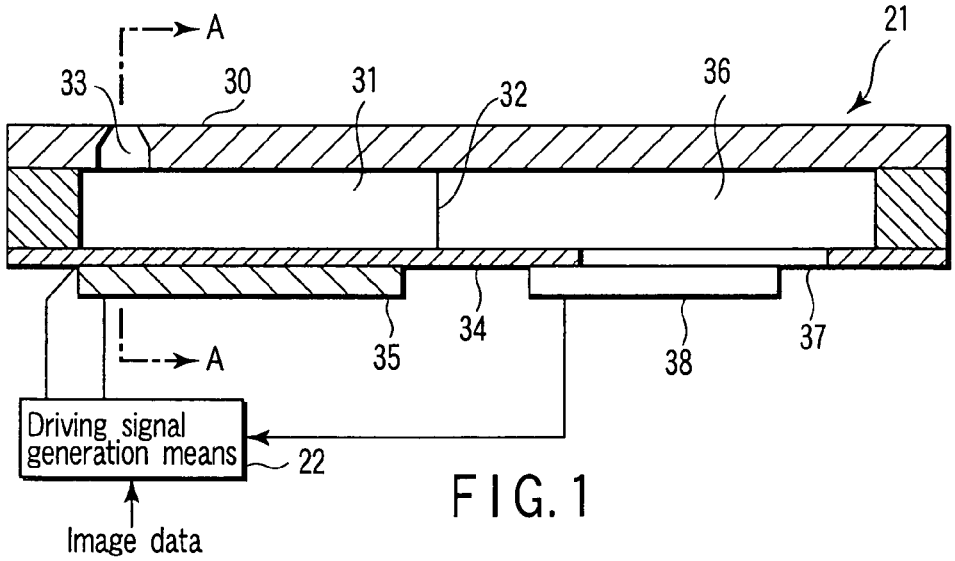
FIG. 1 is a sectional view of the main part of an ink-jet recording head according to a first embodiment of the present invention.
Figure 2:
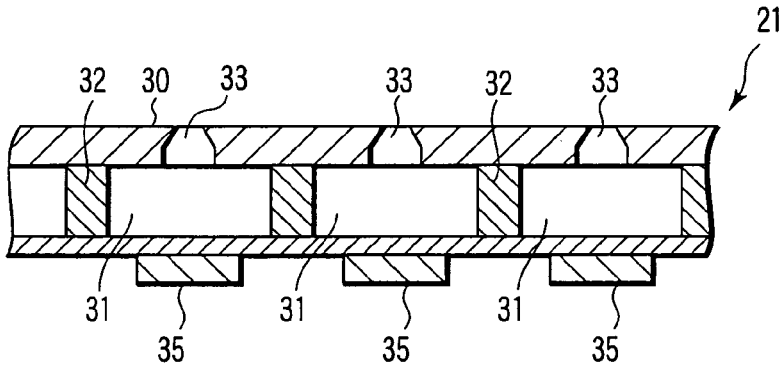
FIG. 2 is a sectional view taken along line A—A of FIG. 1.

Embodiments of the present invention will now be described with reference to the accompanying drawings. FIG. 1 is a sectional view of the main part of an ink-jet recording head according to a first embodiment of the present invention. FIG. 2 is a sectional view taken along line A—A of FIG. 1. Referring to FIGS. 1 and 2, an ink jet head 21 is divided into a plurality of pressure chambers 31 for containing ink. A partition wall 32 is formed between adjacent pressure chambers 31. Each of the pressure chambers 31 has a nozzle 33 for ejecting ink drops. The nozzle 33 is formed in a nozzle plate 30. A vibrating plate 34 is formed on the bottom of each of the pressure chambers 31. A piezoelectric member 35 is fixed on the underside of the vibrating plate 34. The vibrating plate 34 and piezoelectric member 35 make up an actuator.

The ink-jet head 21 includes a common pressure chamber 36 communicating with each of the pressure chambers 31. The common pressure chamber 36 is supplied with ink from ink supply means (not shown) through an ink supply inlet 37. The pressure chambers 31 and nozzle 33 as well as the common pressure chamber 36 are filled with ink. If the pressure chambers 31 and nozzle 33 are filled with ink, a meniscus is formed in the nozzle 33.

Figure 4:
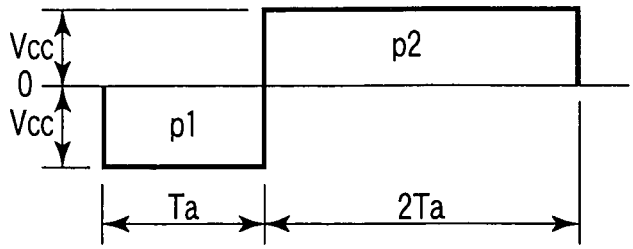
FIG. 4 is a chart showing a waveform of a driving pulse for ink ejection in the ink-jet recording head according to the first embodiment of the present invention.
Figure 6:
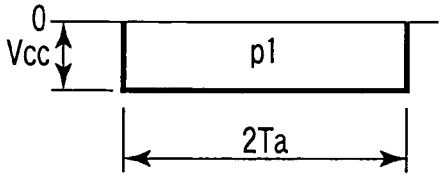
FIG. 6 is a chart showing a waveform of a driving pulse for a precursor in the ink-jet recording head according to the first embodiment of the present invention.

In FIG. 1, reference numeral 22 indicates driving signal generation means that supplies a driving signal to the piezoelectric member 35. The driving signal generation means 22 receives temperature information sensed by a temperature sensor 38 that is attached to the back of the common pressure chamber 36. The means 22 outputs a driving pulse for ink ejection as shown in FIG. 4 and a driving pulse for a precursor as shown in FIG. 6. The means 22 also receives image data.

Figure 3:
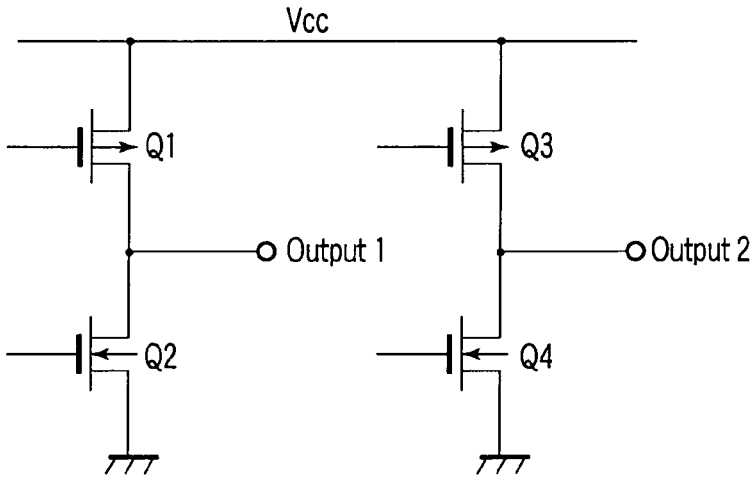
FIG. 3 is a circuit diagram of driving signal generation means of the ink-jet recording head according to the first embodiment of the present invention.

The driving signal generation means 22 includes a circuit that generates a driving pulse for ink ejection and a driving pulse for a precursor as a very low pressure driving signal. This circuit will now be described with reference to FIG. 3. In FIG. 3, a series-connection element of p-channel MOSFET Q1 and n-channel MOSFET Q2 and that of p-channel MOSFET Q3 and n-channel MOSFET Q4 are connected between a single driving power supply Vcc and a ground. The gate potentials of the MOSFETs Q1 to Q4 are controlled independently of each other. An output signal 1 is issued from a node between the p-channel and n-channel MOSFETs Q1 and Q2, and an output signal 2 is issued from a node between the p-channel and n-channel MOSFETs Q3 and Q4. The output signal 1 is supplied to one electrode terminal of the piezoelectric member 35 and the output signal 2 is connected to the other electrode terminal thereof.

The MOSFETs Q1 and Q4 turn on for a period of time Ta and the MOSFETs Q2 and Q3 turn off for a period of time Ta to generate an expanded pulse p1 shown in FIG. 4. Then, the MOSFETs Q1 and Q4 turn off for a period of time 2Ta and the MOSFETs Q2 and Q3 turn on for a period of time 2Ta to generate a contracted pulse p2 shown in FIG. 4. These pulses p1 and p2 compose a driving pulse for ink ejection.

The MOSFETs Q1 and Q4 turn on for a period of time 2Ta and the MOSFETs Q2 and Q3 turn off for a period of time 2Ta to generate an expanded pulse p1 of −Vcc shown in FIG. 6. Only the extended pulse p1 composes a driving pulse for a precursor.

In FIG. 4, Ta indicates a pressure propagation time period required to propagate a pressure wave generated in a pressure chamber 31 from one end of the chamber 31 to the other end thereof.

Figure 5:
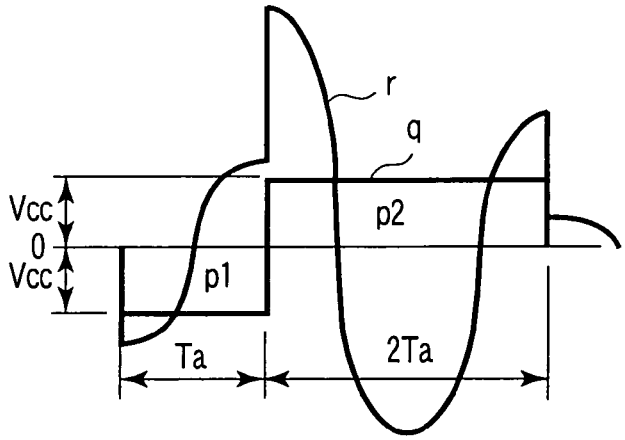
FIG. 5 is a chart showing a relationship between the driving pulse for ink ejection and the pressure of ink in a pressure chamber of the ink-jet recording head according to the first embodiment of the present invention.

FIG. 5 shows a relationship between the driving pulse q for ink ejection shown in FIG. 4, which is generated from the driving signal generation means 22, and the oscillation waveform r of pressure generated in the pressure chambers 31. This relationship will now be described with reference to FIG. 5.

When a voltage of −Vcc is applied between electrodes of the piezoelectric member 35 for a period of time Ta, the member 35 is deformed to increase the capacity of the pressure chambers 31 and thus the pressure chambers 31 generate a negative pressure. This pressure is inverted to a positive pressure as shown in FIG. 5 after a lapse of the pressure propagation time Ta. When the pressure propagation time Ta elapses, a voltage of +Vcc is applied between the electrodes of the piezoelectric member 35 for a period of time 2Ta. The member 35 is thus deformed to decrease the capacity of the pressure chambers 31. The pressure chambers 31 generate a positive pressure. The amplitude of a pressure wave generated from the positive pressure, which is in phase with a pressure wave generated first, is increased suddenly. Concurrently with this, the nozzle 33 ejects an ink drop. 349

When time 2Ta elapses, the pressure in the pressure chambers 31 changes from a positive to a negative and then a positive. If the voltage between electrodes of the piezoelectric member 35 returns to zero during the lapse of time 2Ta, the pressure in the pressure chambers 31 becomes negative and the phase of the pressure wave is reversed. Accordingly, the amplitude of the pressure wave decreases and so does the vibration of the residual pressure.

As described above, the nozzle 33 ejects ink if the driving signal generation means 22 generates a driving pulse q for ink ejection as shown in FIG. 4.

Figure 7:
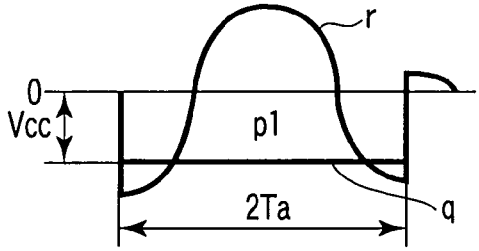
FIG. 7 is a chart showing a relationship between the driving pulse for the precursor and the pressure of ink in the pressure chamber of the ink-jet recording head according to the first embodiment of the present invention.

FIG. 7 shows a relationship between the driving pulse q for the precursor and the vibration waveform r of pressure generated in the pressure chambers 31. This relationship will now be described with reference to FIG. 7. FIGS. 8A to 8D illustrate a meniscus of ink moving in the nozzle 33.

Figures 8A, 8B, 8C, 8D:
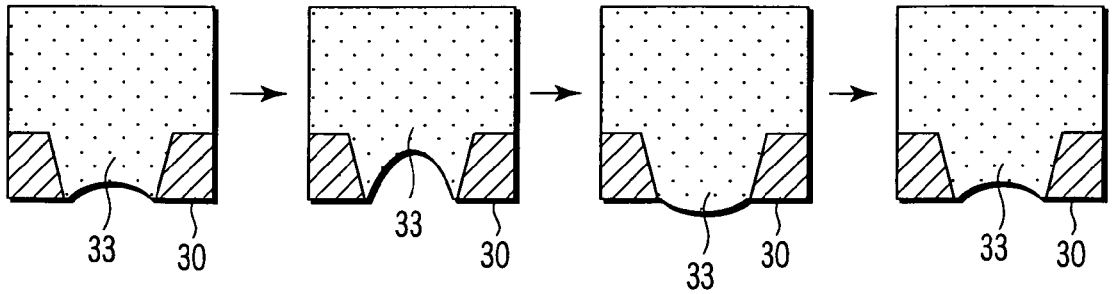
FIGS. 8A to 8D are illustrations of a meniscus of ink moving in a nozzle of the ink-jet recording head according to the first embodiment of the present invention.
Figure 12A:
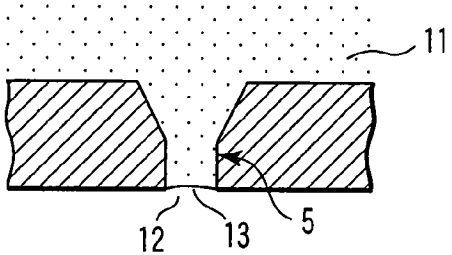
FIGS. 12A to 12E are enlarged views of a nozzle portion of the conventional ink-jet recording head.
Figure 12B:
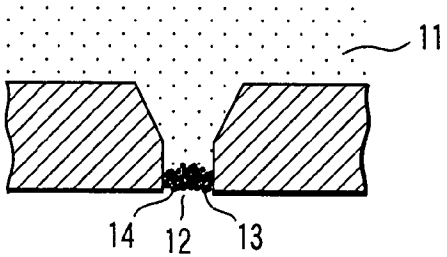
Figure 12C:
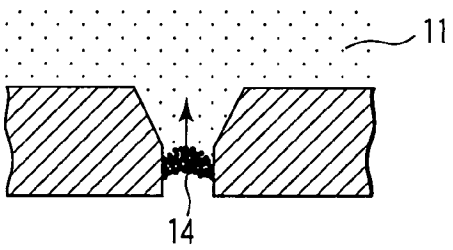
Figure 12D:
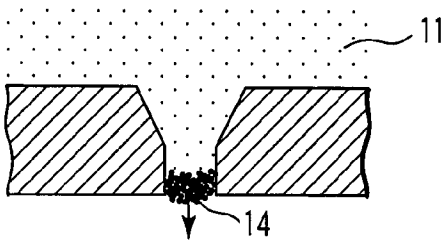
Figure 12E:
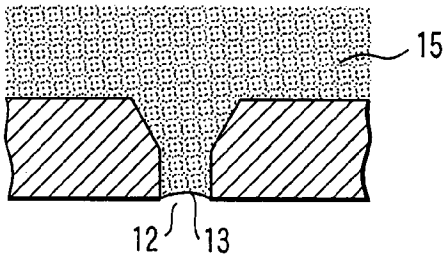
Figure 13A:
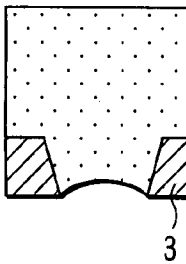
FIGS. 13A to 13D are illustrations of a meniscus of ink moving in a nozzle of the conventional ink-jet recording head.
Figure 13B:
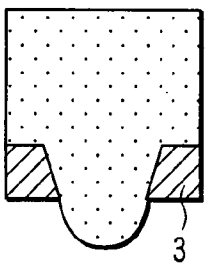
Figure 13C:
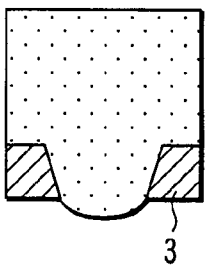
Figure 13D:
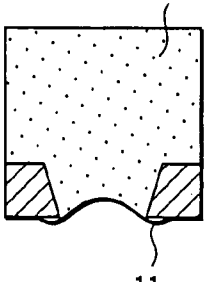

When a voltage of −Vcc is applied between electrodes of the piezoelectric member 35, the member 35 is deformed to increase the capacity of the pressure chambers 31. The pressure chambers 31 thus generate a negative pressure and the meniscus in the nozzle 33 retreats toward the pressure chambers 31 (FIGS. 8A and 8B). After a lapse of time 2Ta that is about twice as long as the pressure propagation time Ta, the pressure in the pressure chambers 31 changes from a negative to a positive and then a negative. If the voltage applied between the electrodes of the piezoelectric member 35 returns to zero when time 2Ta elapses or when the pressure in the pressure chambers 31 is negative, the increased capacity of the pressure chambers 31 returns to its original size and thus the pressure in the chambers 31 becomes positive. Since, therefore, the phase of the pressure wave is reversed when the voltage returns to zero, the amplitude of the pressure wave decreases and so does the oscillation of the residual pressure.

As described above, the capacity of the pressure chambers 31 increases and returns to its original size such that the meniscus does not change to a convex on the surface of the nozzle plate 30 by the driving pulse q for the precursor. The time required for returning the capacity is set twice as long as the pressure propagation time Ta. Therefore, the capacity of the pressure chambers 31, which increases when the pressure in the chambers 31 is negative, returns to its original size. The pressure vibration is attenuated and the convex of the meniscus of reacting ink is minimized as illustrated in FIG. 8C. After that, the meniscus returns to a position in the nozzle 33 as shown in FIG. 8D.

With the above operation, the driving pulse q for the precursor can prevent ink from attaching and remaining on the surface of the nozzle plate 30 near the nozzle 33. The ejecting direction of ink drops can thus be prevented from shifting to thereby achieve stable, high-quality printing.

The driving pulse for a precursor and that for ink ejection are generated by the same driving power supply Vcc. The costs for the ink-jet recording head apparatus can thus be lowered with a simple configuration of the driving circuit.

The driving period Tc of a driving pulse for a precursor shown in FIG. 9A is about ten times as long as the driving period Tb of a driving pulse for ink ejection shown in FIG. 9B.

If Tc is considerably longer than Tb, the ink-jet recording apparatus can decrease in power consumption when it stands by for printing.

Even though a driving pulse for a precursor is applied between electrodes of the piezoelectric member 35 a given number of times, ink in the nozzle 33 is likely to increase in viscosity when nonprinting time is longer than a certain period of time.

In the above case, a spit operation is periodically performed to discharge the ink that increases in viscosity in a nonprinting area. The driving circuit shown in FIG. 3 can generate a driving pulse in the spit operation. The driving waveform of the driving pulse is the same as that shown in FIG. 4, as is the driving voltage Vcc thereof.

As described above, the spit operation is performed when nonprinting time is longer than a certain period of time. It is thus possible to prevent ink from attaching and remaining on the surface of the nozzle plate near the nozzle. Consequently, it is possible to prevent the ejecting direction of ink drops from shifting, thereby achieving stable, high-quality printing.

The driving power supply of a driving pulse in the spit operation is the same as the power supply Vcc of both the driving pulse for a precursor and that for ink ejection. The arrangement of the driving circuit can be simplified to lower the costs for the ink-jet recording apparatus.

When the apparatus turns off and sits idle for a long period of time, ink in the nozzle 33 considerably increases in viscosity or solidifies. No advantages can thus be obtained even using the same driving pulse as those for the precursor and spit operations described above.

In order to resolve the above problem, an ink-jet recording apparatus according to a second embodiment of the present invention will now be described with reference to FIG. 10. Referring to FIG. 10, a tube 42 is connected to a common ink chamber 36 through an ink supply inlet 37 and a filter 41. The tube 42 is provided with an ink filling pump 43 that allows ink to flow in forward and backward directions. The inlet of the pump 43 is connected to an ink bottle 44. A driving unit 45 controls the pump 43 to allow ink to flow forward and backward.

Assume that the ink-jet recording apparatus with the above configuration turns off and sits idle for a long period of time and ink in the nozzle 33 considerably increases in viscosity or solidifies. First, the pump 43 is driven in the backward direction to cause ink to flow from the nozzle 33 in the direction of arrow a through the tube 42. The ink is agitated in a pressure chamber 31. Then, the pump 43 is driven in the forward direction to discharge ink from the pressure chamber 31 through the nozzle 33 and supply a new ink into the pressure chamber 31 from the pressure chamber 31 in the ink bottle 44.

The above operation makes it possible to prevent ink that increases in viscosity and a coagulation of solidified ink from attaching and remaining on the surface of the nozzle plate near the nozzle. Consequently, the ejecting direction of ink drops can be prevented from shifting to thereby achieve stable, high-quality printing.

When the pump 43 causes ink to flow backward from the nozzle 33 to the pressure chamber 31 and agitate it therein, a cap can be put on the nozzle plate to apply a positive pressure.

A driving pulse for a precursor can be generated from the driving signal generation means 22 to return ink to the pressure chamber 31 from the nozzle 33 and agitate the ink while slightly oscillating the pressure chamber 31.

In the above embodiments, the driving period Tc of a driving pulse for a precursor is about ten times as long as the driving period Tb of a driving pulse for ink ejection. However, the embodiments are not limited to this.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An ink-jet head driving method for an ink-jet recording apparatus including a pressure chamber that contains ink, a nozzle communicating with the pressure chamber, which ejects the ink from the pressure chamber, an actuator of an ink-jet head that increases and decreases a capacity of the pressure chamber, and a driving signal generation unit that supplies the actuator with a driving signal to eject an ink drop from the nozzle, the method comprising:

supplying the actuator with a very low pressure driving signal to increase the capacity of the pressure chamber and then return the increased capacity to an original size when no ink is ejected from the nozzle, wherein a pulse width of the very low pressure driving signal is about twice as long as a pressure propagation time period during which a pressure wave in the ink propagates through the pressure chamber;

wherein the very low pressure driving signal is supplied to the actuator a given number of times and then the driving signal to eject an ink drop from the nozzle is periodically supplied to the actuator while the nozzle is outside a printing area.

2. The ink-jet head driving method according to claim 1, wherein the driving signal to eject an ink drop from the nozzle and the very low pressure driving signal have a same driving voltage.

3. The ink-jet head driving method according to claim 1, wherein a period of the very low pressure driving signal is longer than a period of the driving signal to eject an ink drop from the nozzle.

4. An ink-jet recording apparatus comprising:

a pressure chamber that contains ink;

a nozzle communicating with the pressure chamber, which ejects the ink from the pressure chamber;

an actuator of an ink-jet head that increases and decreases a capacity of the pressure chamber; and a driving signal generation unit that supplies the actuator with: (i) a very low pressure driving signal to increase the capacity of the pressure chamber and then return the increased capacity to an original size when no ink is ejected from the nozzle, wherein a pulse width of the very low pressure driving signal is about twice as long as a pressure propagation time period during which a pressure wave in the ink propagates through the pressure chamber, and (ii) a driving signal to eject an ink drop from the nozzle;

wherein driving signal generation unit supplies the very low pressure driving signal to the actuator a given number of times, and then the driving signal generation unit periodically supplies the driving signal to eject an ink drop from the nozzle while the nozzle is outside a printing area.

5. The ink-jet ink-jet recording apparatus according to claim 4, wherein the driving signal to eject an ink drop from the nozzle and the very low pressure driving signal have a same driving voltage.

6. The ink-jet ink-jet recording apparatus according to claim 4, wherein a period of the very low pressure driving signal is longer than a period of the driving signal to eject an ink drop from the nozzle.

7. An ink-jet recording apparatus comprising:

a pressure chamber that contains ink;

a nozzle communicating with the pressure chamber, which ejects the ink from the pressure chamber;

an actuator of an ink-jet head that increases and decreases a capacity of the pressure chamber; and means for supplying the actuator with: (i) a very low pressure driving signal to increase the capacity of the pressure chamber and then return the increased capacity to an original size when no ink is ejected from the nozzle, wherein a pulse width of the very low pressure driving signal is about twice as long as a pressure propagation time period during which a pressure wave in the ink propagates through the pressure chamber, and (ii) a driving signal to eject an ink drop from the nozzle;

wherein driving signal generation unit supplies the very low pressure driving signal to the actuator a given number of times, and then the driving signal generation unit periodically supplies the driving signal to eject an ink drop from the nozzle while the nozzle is outside a printing area.

8. The ink-jet recording apparatus according to claim 7, wherein the driving signal to eject an ink drop from the nozzle and the very low pressure driving signal have a same driving voltage.

9. The ink-jet recording apparatus according to claim 7, wherein a period of the very low pressure driving signal is longer than a period of the driving signal to eject an ink drop from the nozzle.

* * * * *